US007124469B2

(12) United States Patent
Tsekhanovsky et al.

(10) Patent No.: US 7,124,469 B2
(45) Date of Patent: Oct. 24, 2006

(54) AUTOMATIC SLIDING DOOR CLOSURE DEVICE

(76) Inventors: Alex Tsekhanovsky, 93 Mark La., Fox Lake, IL (US) 60020; Todd J. Mattson, 22465 N. 105th Dr., Peoria, AZ (US) 85383

( * ) Notice: Subject to any disclaimer, the term of this patent is extended or adjusted under 35 U.S.C. 154(b) by 18 days.

(21) Appl. No.: 10/613,370

(22) Filed: Jul. 3, 2003

(65) Prior Publication Data

US 2005/0000057 A1 Jan. 6, 2005

(51) Int. Cl.
*E05F 1/08* (2006.01)

(52) U.S. Cl. ..... 16/79; 49/404

(58) Field of Classification Search ..... 16/79, 16/76–78, 72, 61, 63, 67, 66, 197, DIG. 31; 49/404, 381, 386, 405, 379, 394, 449; 160/191, 160/192

See application file for complete search history.

(56) References Cited

U.S. PATENT DOCUMENTS

| | | | | | |
|---|---|---|---|---|---|
| 22,874 | A | * | 2/1859 | Hudson | 16/80 |
| 1,515,155 | A | * | 11/1924 | Meagher | 16/71 |
| 3,887,962 | A | * | 6/1975 | Mills | 16/72 |
| 3,938,282 | A | | 2/1976 | Goyal | |
| 4,004,372 | A | * | 1/1977 | Beard et al. | 49/404 |
| 4,097,957 | A | | 7/1978 | Kitutaka | |
| 4,126,912 | A | | 11/1978 | Johnson | |
| 4,296,570 | A | * | 10/1981 | Balbach et al. | 49/360 |
| 4,330,960 | A | * | 5/1982 | Hasemann et al. | 49/404 |
| 4,357,732 | A | | 11/1982 | Hickman | |
| 4,471,575 | A | * | 9/1984 | Stout | 49/404 |
| 4,675,938 | A | * | 6/1987 | Bundschuh | 16/63 |
| 4,891,911 | A | | 1/1990 | Yung | |
| 5,131,188 | A | | 7/1992 | Hutchison et al. | |
| 5,247,763 | A | | 9/1993 | Hein | |
| 5,251,402 | A | * | 10/1993 | Richardson et al. | 49/404 |
| 5,285,596 | A | * | 2/1994 | Kinsey | 49/404 |
| 5,313,739 | A | * | 5/1994 | Nelson et al. | 49/404 |
| 5,325,628 | A | | 7/1994 | Yingling | |
| 5,365,636 | A | * | 11/1994 | Jensen | 16/67 |
| 5,579,607 | A | | 12/1996 | Braid | |
| 5,622,007 | A | | 4/1997 | Archer | |
| 5,630,249 | A | * | 5/1997 | Rebai, Jr. | 16/78 |
| 5,659,999 | A | * | 8/1997 | Benson | 49/404 |

(Continued)

FOREIGN PATENT DOCUMENTS

GB EP 0567262 A1 * 10/1993

(Continued)

*Primary Examiner*—Robert J. Sandy
*Assistant Examiner*—Andre' L. Jackson
(74) *Attorney, Agent, or Firm*—Meroni & Meroni, P.C.; Charles F. Meroni, Jr.

(57) ABSTRACT

An automatic sliding door closure device for use with a sliding door on a track. The device comprises a housing attached to the door having a connecting arm attached to the housing. A pulley rotatably mounted within the housing guides a cable having an exterior end attached to the doorframe and an interior end connected to the gear, rotating the gear when the sliding door is slid along the track. A spring engaged with the gear tensions rotation of the gear as the door is moved. An airtight cylinder parallel with the track has a plunger arm connected to the connecting arm that is drawn within the cylinder as the door is moved. A flexible member connected to the plunger arm creates an air cushion within the cylinder. An airflow control valve controls intake and outlet of air into the airtight cylinder controlling the closure speed of the door.

24 Claims, 11 Drawing Sheets

U.S. PATENT DOCUMENTS

| | | | | |
|---|---|---|---|---|
| 6,021,607 | A * | 2/2000 | Angove | 49/404 |
| 6,186,298 | B1 | 2/2001 | Wake | |
| 6,481,160 | B1 * | 11/2002 | Kowalczyk | 49/335 |
| 6,578,320 | B1 * | 6/2003 | Munton | 49/404 |
| 6,735,820 | B1 * | 5/2004 | Teutsch | 16/72 |

FOREIGN PATENT DOCUMENTS

| | | | |
|---|---|---|---|
| JP | 02164994 | A * | 6/1990 |
| JP | 11002064 | A * | 1/1999 |

* cited by examiner

AUTOMATIC SLIDING DOOR CLOSURE DEVICE

BACKGROUND OF THE INVENTION

1. Field of the Invention

The present invention generally relates to sliding doors. More specifically, the present invention relates to automatic sliding door closure devices.

2. Description of the Prior Art

Many buildings and homes have manually or automatically operated sliding doors. Many of the sliding doors used in commercial settings are designed with elaborate systems to automatically open when approached and close after a period of time. The following are previously issued United States Patents disclosing sliding door closure systems of this type.

U.S. Pat. No. 4,357,732 issued to Hickman discloses an automatic door closer kit for a sliding door assembly. The door closure kit is gravity actuated and comprises a counterbalance having an adjustable weight capacity, an anchor pulley mechanism having a grooved pulley wheel thereon and mounted on the lintel and one of the rails, a traveling pulley mechanism having a grooved pulley wheel thereon and mounted on the upper edge of the second side of a movable door, and a lifting pulley mechanism having a grooved pulley wheel thereon and mounted on an upper portion of the stationary panel adjacent a second frame. A cord, having one end attached to the counterbalance, is entrained over the lifting pulley then about the anchor pulley and about the traveling pulley and the other end is secured to a hook on the anchor pulley mechanism.

U.S. Pat. No. 5,131,188 issued to Hutchison discloses a device for automatically returning a sliding door or window to a predetermined position within a stationary frame.

The sliding doors used in most households are typically designed to be manually opened and closed. Several different types of kits have been devised to retrofit a manually operated door to automatically close these types of doors. The following are previously issued United States Patents disclosing sliding door closure devices of this type.

U.S. Pat. No. 4,097,957 issued to Kitutka discloses an automatic door closing device for use in a sliding type door. The device includes a driving section having a spiral spring disposed in a casket to urge the sliding door toward closing direction and a buffer mechanism having a cylinder and a piston for moderating closing speed of the door. The device is sufficient for its intended use but requires lubricating oil to operate, making the maintenance of the device messy.

U.S. Pat. No. 5,622,007 issued to Archer discloses an automatic sliding door closing device comprised of two elongated arms coupled together at their proximal ends by a coiled spring which spreads the distal ends of the elongated arms apart. This type of device is simpler in design but presents an unattractive appearance when in use.

Accordingly, there is a need for an automatic door closure device that may be easily installed on a preexisting sliding door in household settings that does not require lubrication oil for operation, and is not obtrusive to the aesthetic appearance of the sliding door entry.

SUMMARY OF THE INVENTION

To answer the need for an automatic door closure device that may be easily installed on a preexisting sliding door in household settings, the claimed invention provides an Automatic Sliding Door Closure Device.

An objective of the claimed invention is to provide an Automatic Sliding Door Closure Device that can be installed on a sliding door designed for manual operation.

Another objective of the claimed invention is to provide an Automatic Sliding Door Closure Device that does not require lubricating oil to operate.

A further objective of the claimed invention is to provide an Automatic Sliding Door Closure Device that has simplified design for improved manufacturability.

An even further objective of the claimed invention is to provide an Automatic Sliding Door Closure Device with improved performance.

To accomplish these objectives, as well as those that will become apparent after reading this specification and viewing the appended drawings, the claimed invention provides an Automatic Sliding Door Closure Device. The Automatic Sliding Door Closure Device generally comprises a housing, a pulley, a cable, a first gear with tensioning means, a second gear with tensioning means and an air piston assembly. The pulley is rotatably mounted within the housing and guides a cable having an exterior end attached to the doorframe and an interior end connected to the first gear, rotating the first and second gears when the sliding door is slid along the track. The first and second gears are rotatably mounted within the housing with tensioning means that store tensioned energy within the tensioning means during movement of the sliding door toward an open position.

The air piston assembly is used to control the closure speed of the sliding door. The air piston assembly has an airtight cylinder that is mounted parallel with the sliding door track and a plunger arm connected to the housing by a connecting arm which is drawn within the cylinder as the door is moved toward the open position. A flexible member connected to the plunger arm draws air into the cylinder through an airflow control valve that acts as an air cushion. The airflow control valve controls intake and outlet of air into the airtight cylinder controlling the closure speed of the door.

BRIEF DESCRIPTION OF THE DRAWINGS

FIG. 1 shows the automatic door closure device installed upon a sliding door type entry.

FIG. 2 shows the left side housing.

FIG. 3 shows the right side housing.

FIG. 4 shows a plan view of the back side of the gears and pulley.

FIG. 5 shows a plan view of the side of the gears and pulley.

FIG. 6 shows a perspective view of the device with a portion of the left side housing removed.

FIG. 7 shows a perspective view of the device with a portion of the right side housing removed.

FIG. 8 shows a perspective view of the device installed on a sliding door where the sliding door is partially opened.

FIG. 9 shows an enlarged view of the air piston assembly.

FIG. 10 shows a cross sectional view of the air flow control valve.

FIG. 11 shows the device installed on a sliding door where the sliding door is partially opened.

DETAILED DESCRIPTION OF THE PREFERRED EMBODIMENT

Figure 1:
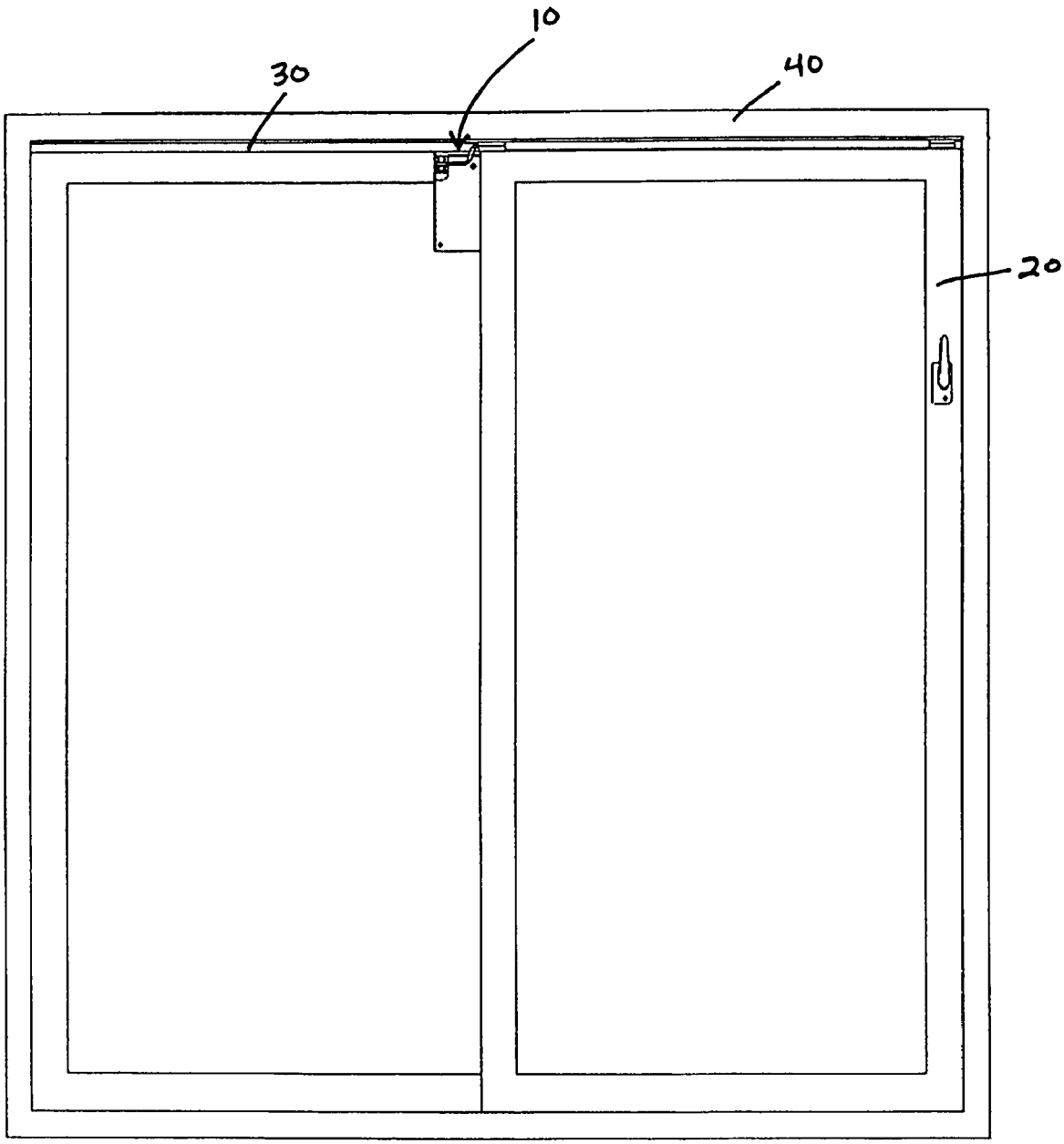
FIG. 1.
Figure 11:
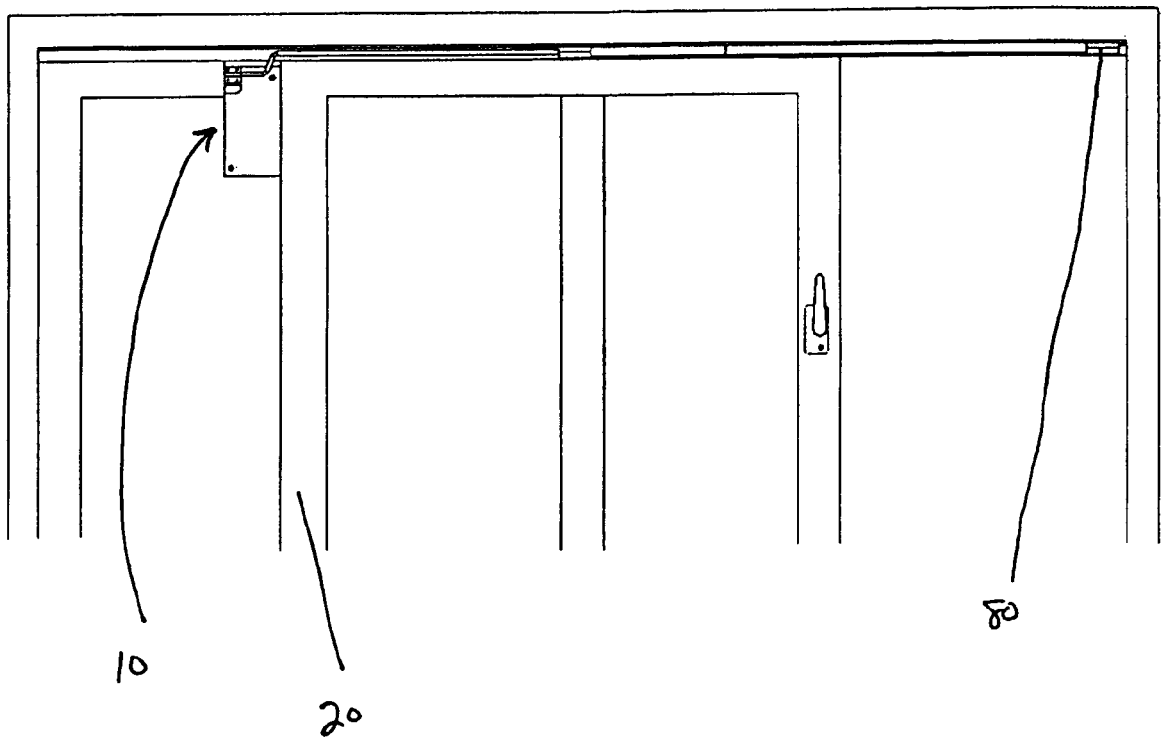
FIG. 11.

Turning now to the drawings, FIGS. 1 and 11 show an automatic sliding door closure device 10 installed on a sliding door 20 slidably engaged with a sliding door track 30 within a door opening entry 40. The automatic sliding door closure device 10 generally comprises a left housing 50, a right housing 60, a pulley 70, a cable 80, a first gear 90 with tensioning means 100, a second gear 110 with tensioning means 120 and an air piston assembly 130.

Figure 2:
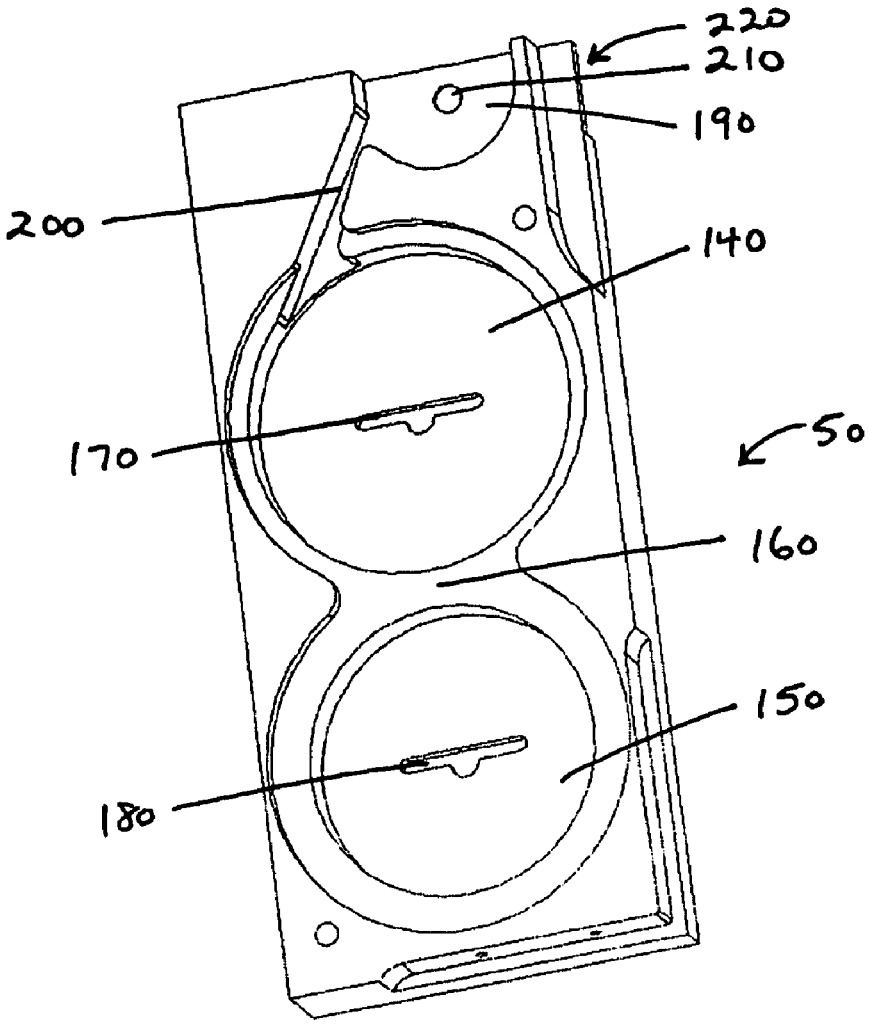
FIG. 2.
Figure 3:
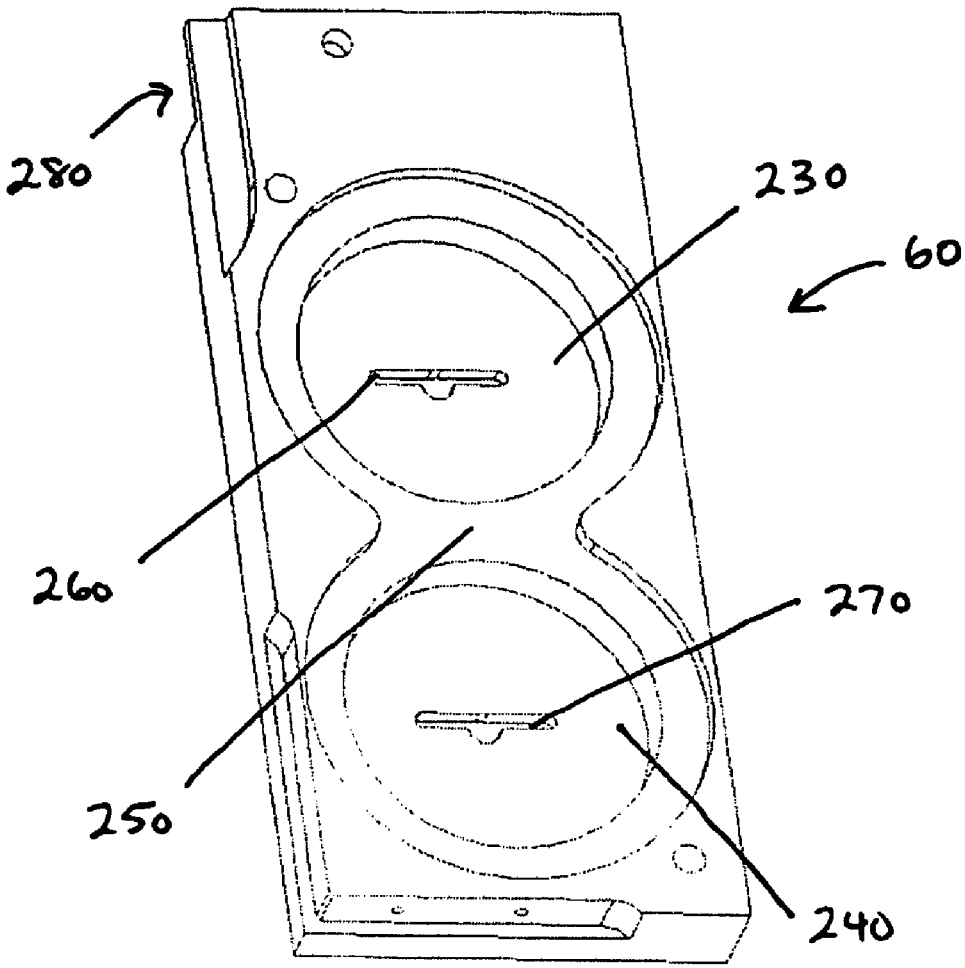
FIG. 3.

The left housing 50 as shown in FIG. 2 has a first inset 140 for receiving the first gear 90 and a second inset 150 for receiving the second gear 110. The first and second insets 140, 150 share a common opening 160 where the first gear 90 and second gear 110 operably mesh together. Each inset 140, 150 has a slot 170, 180 for receiving an axle that the gears 90, 110 rotate about during use of the device 10. A pulley inset 190 is located adjacent the first inset 140 for receiving the pulley 70 and has a cable guide channel 200 for guiding the cable 80 from the pulley 70 to the first gear 90. The pulley inset 190 has a slot 210 for receiving an axle that the pulley 70 rotates about during use of the device 10. A left exterior relief 220 provides clearance for the left housing 50 to be placed adjacent the track 30 of the sliding door 20.

The pulley 70 as shown in FIGS. 4–7 is mounted upon an axle within the pulley inset 190 of the left housing 50 and adjacent the right housing 60. The pulley 70 functions to tension the cable 80 during movement of the sliding door 20 and direct the cable 80 from a generally parallel orientation with the sliding door track 30 to a generally perpendicular orientation with the sliding door track 30 where the cable 80 engages the pulley portion 290 of the first gear 90.

Figure 4:
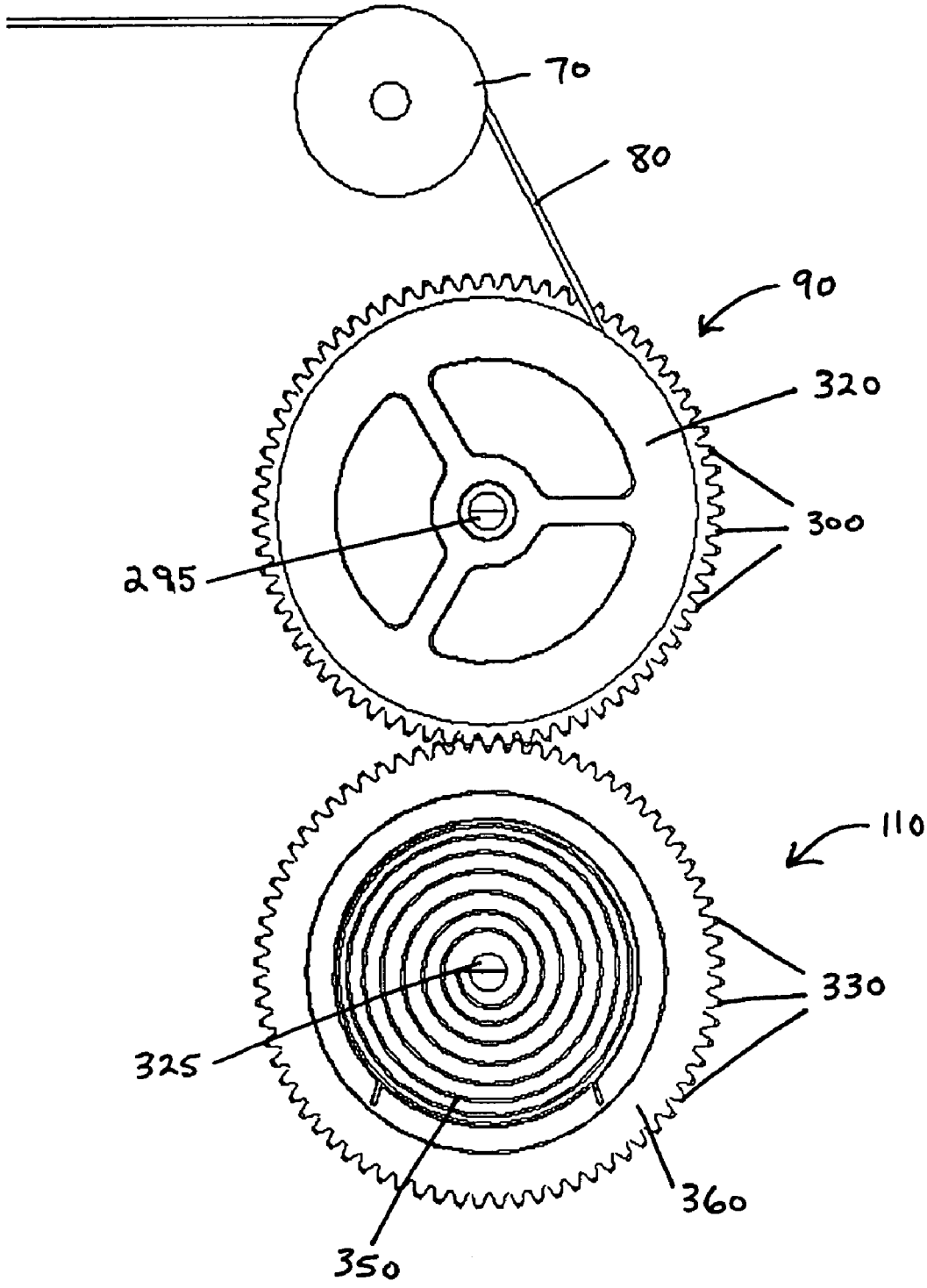
FIG. 4.
Figure 5:
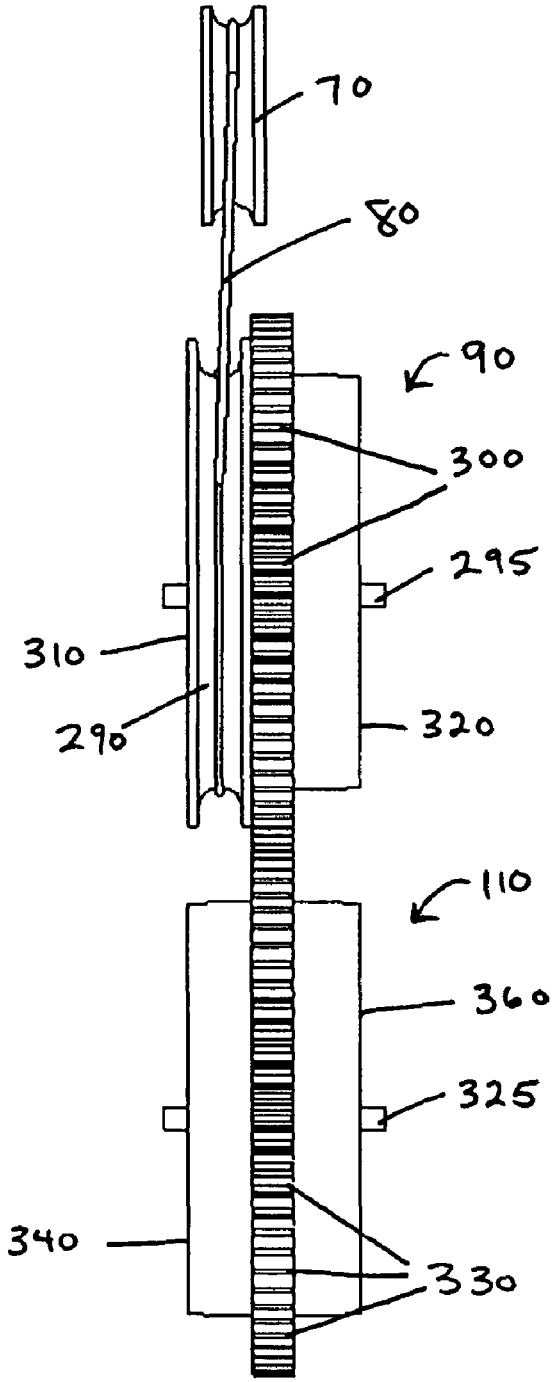
FIG. 5.
Figure 6:
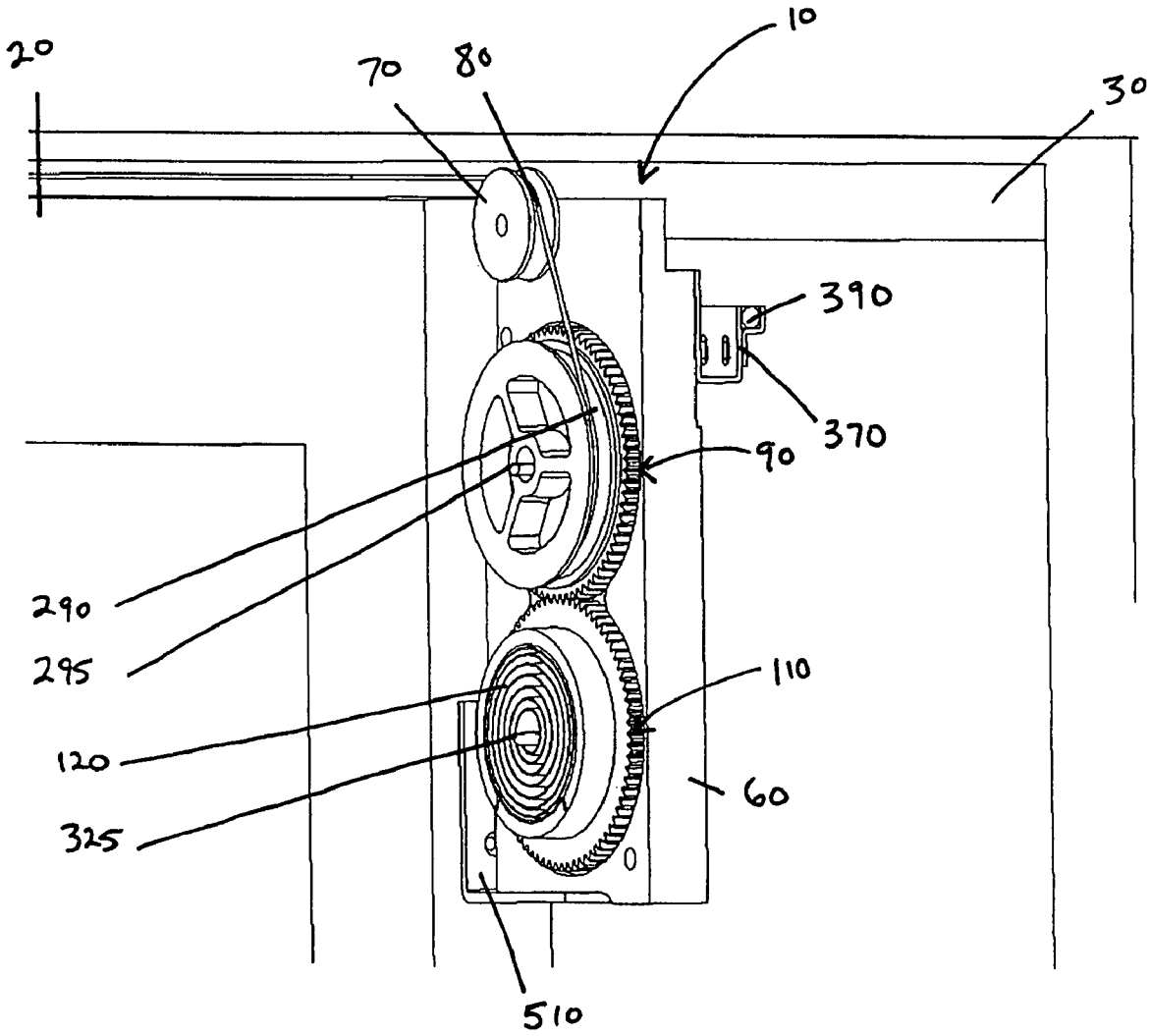
FIG. 6.

The cable 80 as shown in FIGS. 4–6 has an exterior end attached to a portion of the door frame or door jamb and an interior end that is connected to and kept by the pulley portion 290 of the first gear 90 during use. The cable 80 is directed from the pulley 70 to the first gear 90 by the cable guide channel 200 that extends from the pulley inset 190 to the first inset 140.

The first gear 90 as shown in FIGS. 4–7 is rotatably mounted on an axle 295 within the first inset 140 of the left housing 50 and the third inset 230 of the right housing 60. The first gear 90 has a plurality of radially spaced teeth 300 and a pulley portion 290 aligned with the pulley 70 for keeping the cable 80 on the front face 310 of the first gear 90. The first tensioning means 100, preferably a clock spring type spring that engages the back face 320 of the first gear 90, tensions rotation of the first gear 90.

The second gear 110 as shown in FIGS. 4–7 is rotatably mounted on an axle 325 within the second inset 150 of the left housing 50 and the fourth inset 240 of the right housing 60. The second gear 110 has a plurality of radially spaced teeth 330 in meshed relation with the teeth 300 of the first gear 90. The second tensioning means 120, preferably in the form of a clock spring type spring, engages the front face 340 of the second gear 110 and a third tensioning means 350 of the same type engages the back face 360 of the second gear, tensioning rotation of the second gear.

Figure 8:
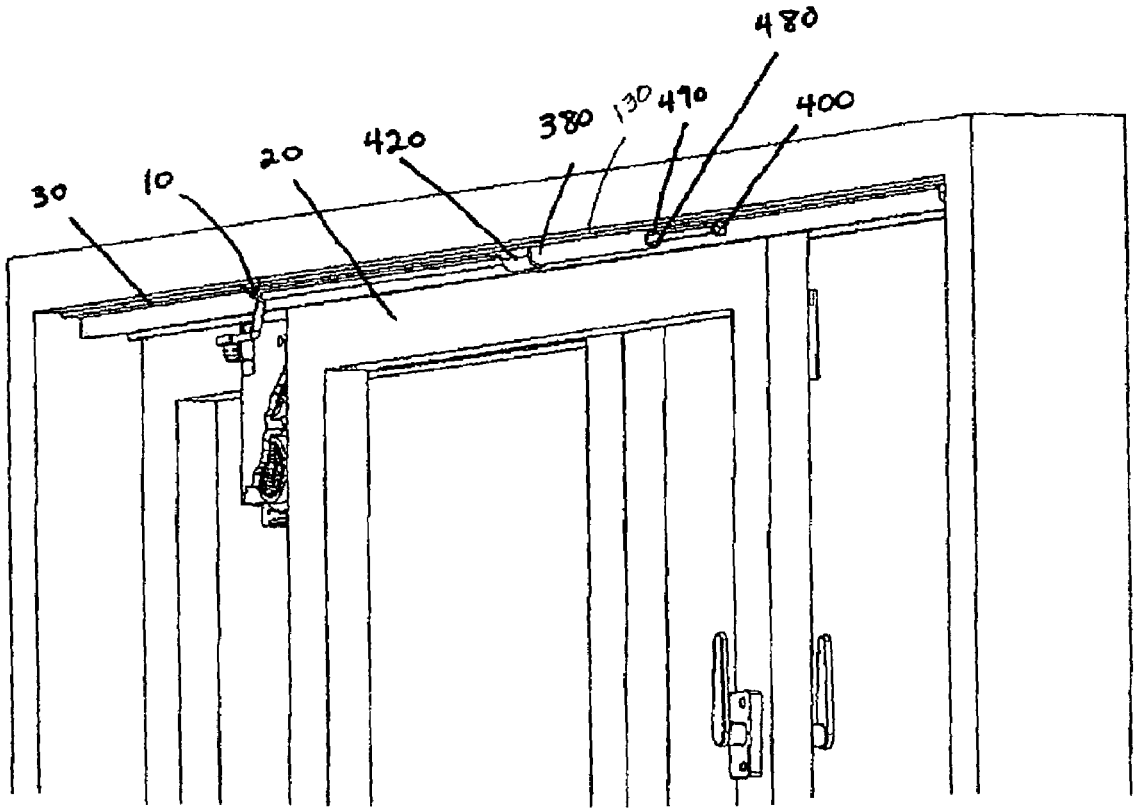
FIG. 8.
Figure 9:
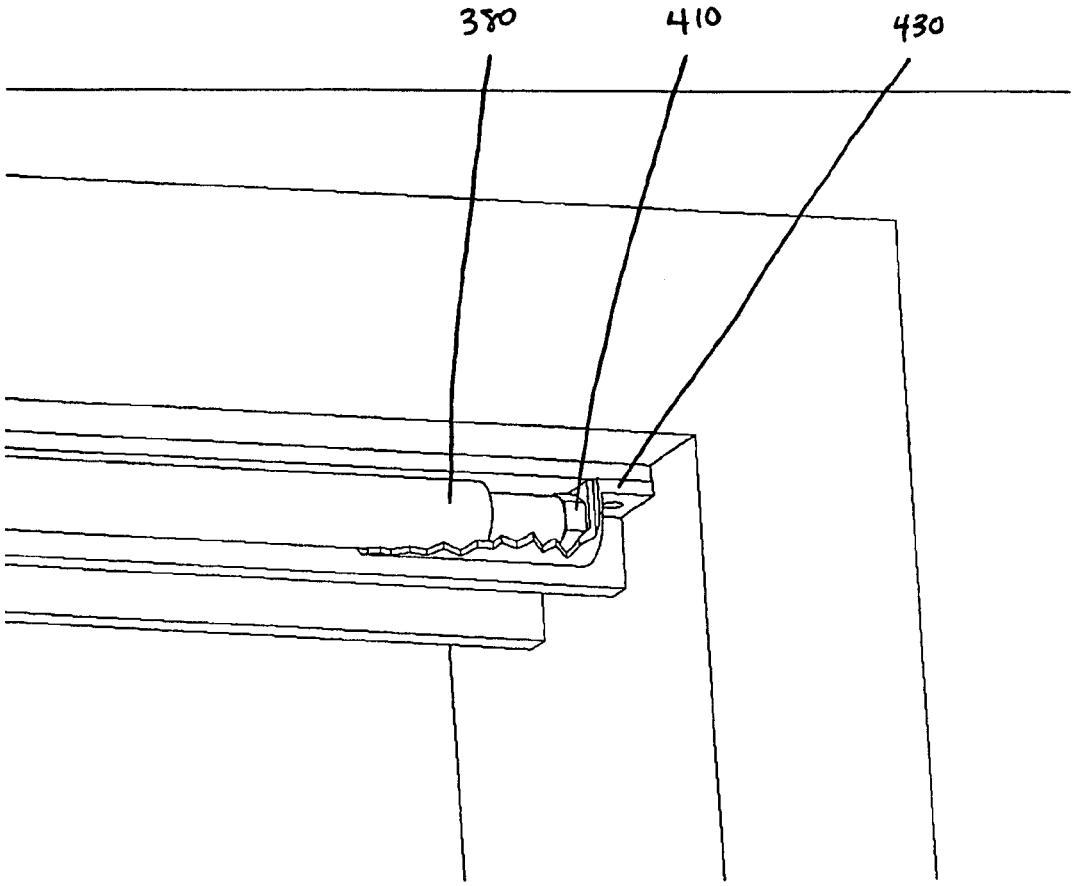
FIG. 9.

The air piston assembly 130 as shown in FIGS. 8–11 generally comprises a connecting arm 370, an airtight cylinder 380, a plunger arm 390, a flexible member 400 and an airflow control valve 410. An arm side bracket 420 as shown in FIG. 8 and a valve side bracket 430 as shown in FIG. 9 are used to attach the air piston assembly 130 to the top of the door opening 40. The arm side bracket 420 is sized and shaped to receive the first end 440 of the airtight cylinder 380 and has an aperture 450 through the bracket 420 for movement of the plunger arm 390 within the aperture 450 during use of the device 10. An air tight seal about the plunger arm 390 maintains air pressure within the airtight cylinder 380. The valve side bracket 430 is sized and shaped to receive the second end 460 of the airtight cylinder 380 and has an aperture 470 providing an opening for airflow into and out of the airflow control valve 410.

Figure 7:
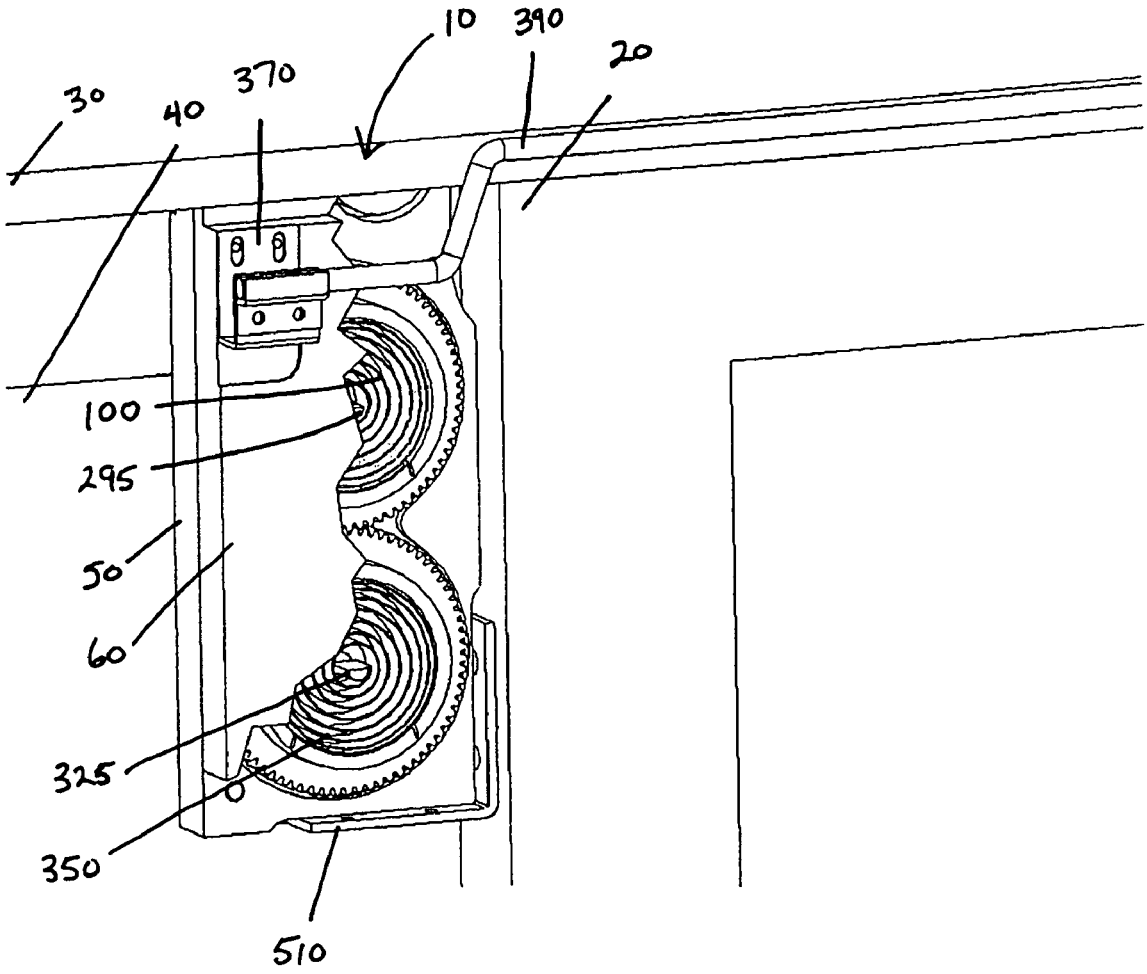
FIG. 7.

The connecting arm 370 is connected to the right housing 60 and to the plunger arm 390 as shown in FIGS. 6–8. The flexible member 400, preferably a leather cup, is connected to the plunger arm 390 that slidably contacts the inner walls 480 of the airtight cylinder 380, creating an air cushion within the cylinder 380 during use of the device 10.

The airtight cylinder 380 as shown in FIGS. 8–9 is generally oriented parallel with the sliding door track 30 of the sliding door 20 as shown in FIG. 8 and has a hollow interior cavity 490 where the plunger arm 390 and flexible member 400 reciprocate during use of the device 10.

Figure 10:
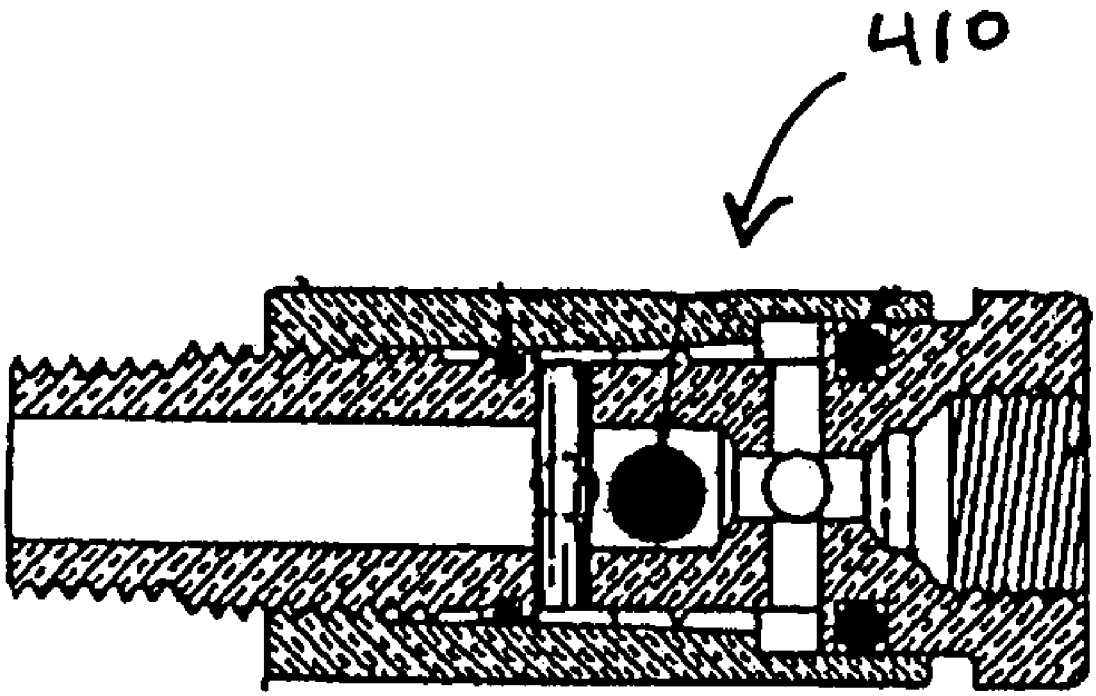
FIG. 10.

The airflow control valve 410 as shown in FIG. 10 is preferably a ball type valve. The airflow control valve 410 is located within a wall 500 of the airtight cylinder 380 at the opposite end from the plunger arm 390. The airflow control valve 410 controls the intake and outlet of air into the airtight cylinder 380 such that the airflow control valve 410 controls the closure speed of a sliding door 20 using the device 10 of the claimed invention.

The device 10 is installed by attaching the housings 50, 60 containing the pulley 70, the cable 80, the first gear 90, first tensioning means 100, the second gear 110 and the second and third tensioning means 120, 350 to the end of a sliding door 20 as shown in FIG. 6 with a bracket 510. The exterior end of the cable 80 is then attached to the door frame adjacent the door jamb. The air piston assembly 130 is then attached to the door frame, preferably adjacent the door track 30 corresponding to the right side housing 60.

In operation, the cable 80 is extracted from the device 10 as the sliding door 20 is slid in an open direction along the track 30. The extraction of the cable 80 from the device 10 rotates the first gear 90 and second gear 110, thereby tensioning the tensioning means 100, 120 and 350. As the sliding door 20 is slid in the open direction, the plunger arm 390 and flexible member 400 are simultaneously drawn within the airtight cylinder 380 toward the first end 440 of the airtight cylinder 380 creating suction within the airtight cylinder 380 that draws air into the airtight cylinder 380 through the airflow control valve 410.

As the sliding door 20 is released, the tension within the tensioning means 100, 120 and 350 is released causing the first gear 90 and second gear 110 to rotate in opposite directions thereby automatically moving the sliding door 20 toward the closed position. The air drawn into the airtight cylinder 380 operates as a cushion to slow the closing speed of the sliding door 20. The airflow control valve 410 is set to release air from within the airtight cylinder 380, dampening the release of tension within the tensioning means 100, 120 and 350.

Although the invention has been described by reference to some embodiments it is not intended that the novel device be limited thereby, but that modifications thereof are intended to be included as falling within the broad scope and spirit of the foregoing disclosure, the following claims and the appended drawings.

We claim:

1. An automatic sliding door closure device, the device comprising:

a housing sized and shaped for attachment to an end of a sliding door during use;

a pulley rotatably mounted within the housing;

a first gear rotatably mounted within the housing having a plurality of radially spaced teeth;

a cable having an exterior end for attachment to a door frame during use and an interior end connected to the first gear rotating the first gear during use;

tensioning means engaged with the first gear tensioning movement of the first gear;

a second gear within the housing having a plurality of radially spaced teeth in meshed relation with the teeth of the first gear;

second tensioning means engaged with the second gear tensioning movement of the second gear during movement of the second gear in an opposite direction from movement of the first gear;

a connecting arm connected to the housing;

an airtight cylinder oriented parallel with a sliding door track of the sliding door during use having a hollow interior cavity;

a plunger arm connected to the connecting arm sized and shaped for movement within the hollow interior cavity of the airtight cylinder;

a flexible member connected to the plunger arm slidably contacting walls of the hollow interior cavity of the airtight cylinder; and an airflow control valve within a wall of the airtight cylinder.

2. The device of claim 1 wherein the first gear has a pulley portion aligned with the pulley for keeping the cable on a front face of the first gear and the tensioning means engages the first gear at a back face of the first gear.

3. The device of claim 2 further comprising a guide channel between the pulley and the first gear sized and shaped to receive the cable.

4. The device of claim 3 wherein the second tensioning means engages a front face of the second gear and further comprises a third tensioning means engaging a back face of the second gear tensioning movement of the second gear during movement.

5. The device of claim 4 wherein the airflow control valve is located in one end of the airtight cylinder and further comprises an airtight seal about the plunger arm located in an opposite end of the airtight cylinder from the airflow control valve.

6. The device of claim 5 further comprising a plunger arm side bracket sized and shaped to receive an end of the airtight cylinder having an aperture through the bracket for movement of the plunger arm within the aperture during use.

7. The device of claim 6 further comprising an airflow control valve side bracket sized and shaped to receive an end of the airtight cylinder having an aperture through the bracket providing an opening for airflow into and out of the airflow control valve.

8. An automatic sliding door closure device in combination with a sliding door, the combination comprising:

a sliding door track within a door opening having a door frame;

a sliding door slidably engaged with the sliding door track;

a housing attached to an end of the sliding door;

a pulley rotatably mounted within the housing;

a first gear rotatably mounted within the housing having a plurality of radially spaced teeth;

a cable having an exterior end for attachment to the door frame and an interior end connected to the first gear, the cable rotating the first gear when the sliding door is slid along the sliding door track;

tensioning means engaged with the first gear tensioning rotation of the first gear as the sliding door is slid along the sliding door track;

a second gear rotatably mounted within the housing having a plurality of radially spaced teeth in meshed relation with the teeth of the first gear, the second gear rotating in an opposite direction from the rotation of the first gear;

second tensioning means engaged with the second gear tensioning rotation of the second gear as the sliding door is slid along the sliding door track;

a connecting arm connected to the housing;

an airtight cylinder oriented parallel with the sliding door track of the sliding door having a hollow interior cavity;

a plunger arm connected to the connecting arm sized and shaped for movement within the hollow interior cavity of the airtight cylinder as the sliding door is slid along the sliding door track;

a flexible member connected to the plunger arm slidably contacting walls of the hollow interior cavity of the airtight cylinder for creating an air cushion within the airtight cylinder; and an airflow control valve within a wall of the airtight cylinder for controlling intake and outlet of air into the airtight cylinder, the airflow control valve controlling closure speed of the sliding door.

9. The device of claim 8 further comprising a guide channel between the pulley and the first gear sized and shaped to receive the cable.

10. The combination of claim 9 wherein the first gear has a pulley portion aligned with the pulley for keeping the cable on a front face of the first gear and the tensioning means engages the first gear at a back face of the first gear.

11. The combination of claim 10 wherein the second tensioning means engages a front face of the second gear and further comprises a third tensioning means engaging a back face of the second gear tensioning movement of the second gear during movement.

12. The combination of claim 11 wherein the airflow control valve is located in one end of the airtight cylinder and further comprises an airtight seal about the plunger arm located in an opposite end of the airtight cylinder from the airflow control valve.

13. The combination of claim 12 further comprising a plunger arm side bracket sized and shaped to receive an end of the airtight cylinder having an aperture through the bracket for movement of the plunger arm within the aperture during use.

14. The combination of claim 13 further comprising an airflow control valve side bracket sized and shaped to receive an end of the airtight cylinder having an aperture through the bracket providing an opening for airflow into and out of the airflow control valve.

15. An automatic sliding door closure device, the device comprising:

a first gear including a pulley;

a cable having a first end for attachment to a top of a horizontal door frame during use and with an opposite end of the cable directly connected to the pulley, the cable being wound with multiple turns on the pulley, the cable and the pulley being operationally oriented during operation with the cable winding and unwinding off the pulley;

at least one tensioning means for connection to a sliding door during use, the tensioning means tensioned by the cable during use;

the first gear engaged with the tensioning means, the tensioning means tensioning rotation of the first gear; and an air tight cylinder having an air piston, which are generally shaped and constructed to be oriented parallel with a sliding door track of a sliding door, said air piston linked to the tensioning means providing controlled release of the tension in the tensioning means controlling closure speed of a sliding door during use.

16. The device of claim 15, wherein the first gear has a pulley portion for keeping the cable on a front face of the first gear, the air piston further having means for creating an air cushion within the air piston during use.

17. The device of claim 15, further comprising a second gear engaged with the first gear and second tensioning means tensioning rotation of the second gear.

18. The device of claim 17, wherein the air piston further comprises a flexible member slidably contacting inner walls of the piston creating an air cushion within the air piston during use.

19. An automatic sliding door closure device, the device comprising:

a cable having a first end attached to a door frame during use;

at least one tensioning means connected to a sliding door during use, the tensioning means tensioned by the cable during use;

a first gear engaged with the tensioning means, the tensioning means tensioning rotation of the first ear;

an air piston linked to the tensioning means providing controlled release of the tension in the tensioning in the tensioning means controlling closure speed of the sliding door during use;

the first gear has a pulley portion for keeping the cable on a front face of the first gear; and a second gear engaged with the first gear and second tensioning means tensioning rotation of the second gear.

20. The device of claim 19, wherein the air piston further comprises a flexible member slidably contacting inner walls of the piston creating an air cushion within the air piston during use.

21. An automatic sliding door closure device, the device comprising:

a cable having a first end attached to a door frame during use;

at least one tensioning means connected to a sliding door during use, the tensioning means tensioned by the cable during use;

an air piston including a piston rod linked to the tensioning means, said piston rod causing a pushing action as the piston rod is moved into the said air piston thus providing a controlled release of the tension in the tension means to control closure speed of the sliding door using use; and a first gear engaged with the tensioning means, the tensioning means tensioning rotation of the first gear.

22. The device of claim 21 wherein the first gear has a pulley portion for keeping the cable on a front face of the first gear.

23. The device of claim 22 further comprising a second gear engaged with the first gear and second tensioning means tensioning rotation of the second gear.

24. The device of claim 23 wherein the air piston further comprises a flexible member slidably contacting inner walls of the piston creating an air cushion within the air piston during use.

* * * * *